US011969122B2

(12) United States Patent
Schankel

(10) Patent No.: US 11,969,122 B2
(45) Date of Patent: Apr. 30, 2024

(54) TOWEL

(71) Applicant: EleryB, LLC, McKinney, TX (US)

(72) Inventor: Tanya Schankel, McKinney, TX (US)

(73) Assignee: EleryB, LLC, McKinney, TX (US)

( * ) Notice: Subject to any disclaimer, the term of this patent is extended or adjusted under 35 U.S.C. 154(b) by 944 days.

(21) Appl. No.: 16/944,349

(22) Filed: Jul. 31, 2020

(65) Prior Publication Data

US 2021/0030218 A1 Feb. 4, 2021

Related U.S. Application Data

(60) Provisional application No. 62/882,201, filed on Aug. 2, 2019.

(51) Int. Cl.
*A41B 13/06* (2006.01)
*A47K 10/02* (2006.01)

(52) U.S. Cl.
CPC ..... *A47K 10/02* (2013.01); *A41B 13/06* (2013.01)

(58) Field of Classification Search
CPC ..... A41B 13/06; A41B 13/103; A47G 9/00; A41D 11/00; A41D 27/201
See application file for complete search history.

(56) References Cited

U.S. PATENT DOCUMENTS 1,139,999 A * 5/1915 Rosenthal ..... A41B 1/04 2/77
1,307,416 A * 6/1919 Pine ..... A41B 9/08 2/78.1
2,242,641 A * 5/1941 Berger ..... A41B 13/06 2/84
3,226,737 A * 1/1966 Rote ..... E04H 15/56 135/120.1
3,477,065 A * 11/1969 Hoover ..... A41B 13/06 2/69.5
5,046,204 A * 9/1991 Mohler ..... A41B 13/06 5/413 R
5,406,659 A * 4/1995 Camp ..... A47G 9/062 52/3
D380,589 S * 7/1997 Westman ..... D2/719
5,722,094 A * 3/1998 Ruefer ..... A41B 13/06 2/69.5
D400,688 S * 11/1998 Federspiel ..... D2/745
D448,914 S * 10/2001 Caudill ..... D2/719
6,389,597 B1 * 5/2002 Henegan ..... A41B 13/06 2/69.5
D470,704 S * 2/2003 Varon ..... D6/608
6,817,033 B2 * 11/2004 Bailey ..... A41B 13/06 2/69.5
6,868,566 B2 * 3/2005 Gatten ..... A41B 13/06 5/413 R
D541,506 S * 5/2007 Heiman-Philpott ..... D2/719
(Continued)

FOREIGN PATENT DOCUMENTS

WO WO-2006055010 A1 * 5/2006 ..... A41B 13/06

OTHER PUBLICATIONS

Crane & Canopy, "Bath Towel Sizes and Common Uses," Aug. 1, 2019, 3 pages.

(Continued)

*Primary Examiner* — Jillian K Pierorazio
(74) *Attorney, Agent, or Firm* — Trop, Pruner & Hu, P.C.

(57) ABSTRACT

An embodiment includes a multi-functional garment, such as a towel.

20 Claims, 12 Drawing Sheets

(56) References Cited

U.S. PATENT DOCUMENTS

D601,327 S * 10/2009 Anderson ..... D2/825
D612,579 S * 3/2010 Dickinson ..... D2/719
D632,855 S * 2/2011 Quinlan ..... D32/40
8,225,422 B1 * 7/2012 McSparron ..... A41B 13/005 2/69.5
D675,808 S * 2/2013 Sutton ..... D2/719
D693,971 S * 11/2013 Daugherty ..... D30/158
D709,304 S * 7/2014 Morin ..... D6/608
9,049,950 B2 * 6/2015 Wu ..... A47G 9/08
D773,860 S * 12/2016 Leinbach ..... D6/608
D790,803 S * 7/2017 Paperno ..... D2/719
9,775,387 B2 * 10/2017 Parr ..... A41D 3/00
D808,609 S * 1/2018 Venosi ..... D99/5
D812,397 S * 3/2018 Davis ..... D6/608
2005/0150047 A1 * 7/2005 Trani ..... A41B 13/06 5/482
2006/0143769 A1 * 7/2006 Pathak ..... A41D 13/04 2/48
2010/0257653 A1 * 10/2010 Pitts ..... A41B 13/06 2/69.5
2011/0035857 A1 * 2/2011 Quintanilla ..... A41B 13/06 2/52
2011/0197365 A1 * 8/2011 Wadia ..... A47D 13/027 5/655
2013/0239290 A1 * 9/2013 Rossi ..... A41D 15/04 2/84
2013/0333113 A1 12/2013 Gotel et al.
2014/0165254 A1 * 6/2014 Bowen ..... A41D 7/008 2/69
2014/0275742 A1 * 9/2014 Andrew ..... A41B 13/06 600/27
2014/0352063 A1 * 12/2014 Mitchell ..... A47G 9/0207 5/494
2014/0352167 A1 * 12/2014 Peters ..... A47K 10/02 2/84
2015/0101101 A1 * 4/2015 Gotel ..... A41B 13/06 2/69.5
2015/0111459 A1 * 4/2015 Anderman ..... A63H 33/00 29/428
2015/0237920 A1 8/2015 Pruitt
2016/0066628 A1 * 3/2016 Shakes ..... A41B 13/06 2/48
2016/0255886 A1 * 9/2016 Arzu ..... A41B 13/00
2017/0202270 A1 7/2017 Read
2018/0332901 A1 * 11/2018 Jennings ..... A41B 13/06
2019/0125108 A1 * 5/2019 Thomas ..... B60N 2/2812
2019/0254355 A1 * 8/2019 Griffin ..... A41B 13/005
2020/0015637 A1 * 1/2020 Lim ..... A47K 10/02

OTHER PUBLICATIONS

The Company Store, "Towel Guide," Aug. 1, 2019, 7 pages total.
NHS, "Washing and Bathing Your Baby," Aug. 6, 2018, 4 pages.

* cited by examiner

TOWEL

CROSS-REFERENCE TO RELATED APPLICATION

This application claims priority to U.S. Provisional Patent Application No. 62/882,201 filed on Aug. 2, 2019 and entitled "TOWEL", the content of which is hereby incorporated by reference.

BACKGROUND

Bath time for a child, particularly a newborn, is typically a very soothing, calming experience for both the child and the parent. This is a time where the child and parent connect and typically produces fond memories for the parent. At the end of bath time, the child is whisked out of the warm water, with a wet and slippery body, and the child generally starts to immediately become cold and uncomfortable. This can result in many children (e.g., newborns) crying and becoming upset. This can be especially disruptive if the bath occurs close to bedtime. Crying children result in nervous parents trying to soothe and calm their distressed child.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

FIG. 11 depicts an embodiment hanging from a hook or the like.

DETAILED DESCRIPTION

Figure 1:
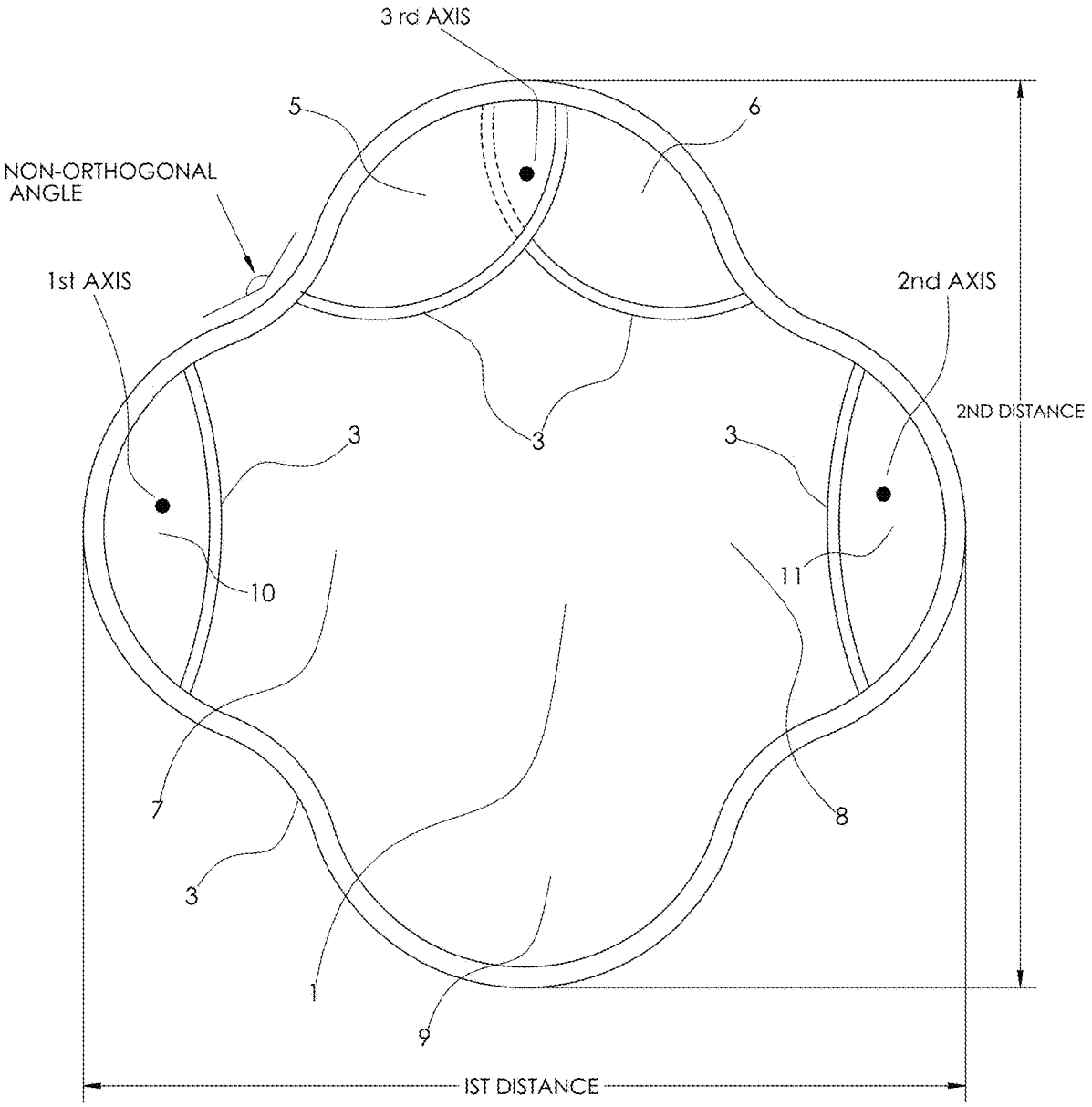
FIG. 1 depicts a front view of an embodiment.

Reference will now be made to the drawings wherein like structures may be provided with like suffix reference designations. In order to show the structures of various embodiments more clearly, the drawings included herein are diagrammatic representations. Thus, the actual appearance of the fabricated structures, for example in a photo, may appear different while still incorporating the claimed structures of the illustrated embodiments. Moreover, the drawings may only show the structures useful to understand the illustrated embodiments. Additional structures known in the art may not have been included to maintain the clarity of the drawings. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical contact with each other and "coupled" may indicate elements co-operate or interact with each other, but they may or may not be in direct physical contact. Phrases such as "comprising at least one of A and B" include situations with A, B, or A and B.

Applicant determined there are at least two types of towel products used today and Applicant further determined both have shortcomings.

First, a baby towel is a smaller footprint towel and is typically diamond or rectangular in shape and made with thin material. Due to the typically thin material, these types of towels do not absorb the water from the child's skin well, and they typically become soaking wet. With the child now wrapped in a soaking wet towel, the child becomes cold and even more uncomfortable after the bath. In addition, thin towels provide little warmth or cushioning comfort to the child's body. The smaller size of this type of towel prevents full drying coverage. Some baby towels have a capped head design that secures the towel to the baby either with a hood or a triangular cap that stretches across the child's forehead. These types of head design are stationary and not flexible.

Second, an adult-sized towel is typically rectangular shaped and much larger than a baby towel. These towels are more absorbent than the above-mentioned thin towels but are cumbersome to use on a child. The rectangular shaped towel does not promote easy swaddling of the child, as the length is too long, and the width is too short to swaddle effectively. When a towel like this is used, the child can be wrapped lengthwise which hinders swaddling of the arms or the child is wrapped widthwise which hinders swaddling of the legs, or adults fumble around with the towel to wrap the baby any way they can while trying to manage a slippery, wet, and often crying baby.

A recommended practice (https://***.nhs.uk/conditions/pregnancy-and-baby/washing-your-baby/) is to wipe each of the child's eyes separately, with different clothes, to prevent cross-infection from one eye to the other. Cross-infection can cause eye infections, tear duct infections, and the like, and possible long-term damage to a child's eyesight or ability for tear ducts to function properly. Neither of the two typical towel solutions described above provides a solution for this.

However, an embodiment includes a towel that is increased (e.g., double or triple) in thickness of most standard towels. It provides warmth and true cushioning comfort. It provides added drying power and an increased layer of cushion between the child and the surface it is placed upon. The towel's size provides a more manageable use in drying as the adult does not have to fumble with either a too-small or too-large towel to cover all the exposed areas of the child's skin which can be difficult and cumbersome to do while holding a slippery, wet, and often crying child. The clover-like shape is designed for easy swaddling functionality with wide, large circular flaps that provide warmth and full drying coverage of the legs and arms. The 2-flap, circular head provides not only warmth, but also flexible use and fit for various head sizes. The flaps can be positioned upon the child's head for drying and warmth then pushed aside when not needed. As an added benefit, each head flap can be used separately to dry each eye of the child reducing the chance for cross-contamination infection. As the child grows, the towel keeps its functionality. The large, circular swaddling flaps have side hand flaps attached so a toddler/preschooler can place the towel on the head, grasp the side hand flaps and wrap the towel around the body. The bottom swaddling flap then rests against the back of the child's legs. Thus, an embodiment provides a better solution of a towel for newborns, toddlers, and preschoolers. Such an embodiment presents a garment (e.g., towel) with improved functionality for a newborn and the towel can grow with the child into their toddler and pre-school years.

Embodiments provide advantages over conventional towels because, for example, the size of the invention corrects both the too-small baby towel; and depending on the adult standard-size towel's direction use, corrects the too-long, not-wide-enough, or the too-wide, not-long-enough manageability of the adult standard-size towels that are currently on the market. With respect to conventional baby towels, an embodiment is wide enough and long enough to provide a more thorough coverage of the infant to fully swaddle the child or partially swaddle the child as he/she grows. When the child grows to a point where swaddling in no longer necessary, the embodiment can then transition to a toddler/preschooler towel. This is typically a time when adults use an adult standard-size towel to dry the child. With respect to the adult towel, an embodiment reduces the standard-size towel to a more manageable size by eliminating the too long or too wide aspects of an adult-size towel while providing thorough coverage. Thus, the size of an embodiment is much larger than a standard baby towel and is shorter in length and wider in width of an adult standard-size towel. The towel is a more manageable and appropriate size for infant and toddler/preschooler's use.

Embodiments provide advantages over conventional towels because, for example, a unique clover-like shape promotes quick and easy swaddling and full body drying coverage. Easy swaddling is achieved by using three wide, circular swaddling flaps that allow the folding and tucking essential for securing and swaddling a baby. The swaddling provides comfort to the child and reduces stress to the child and adult. Conventional baby towels are diamond or rectangular in shape which do not provide as-easy swaddling. The diamond/rectangular shape does not fully cover the child's body. The tip of the towel is narrow, whereas an embodiment's wide, circular swaddling flaps cover area for full body drying. The swaddling flaps of an embodiment are wider and bigger than a conventional diamond shape baby towel and provide full coverage to the child for drying and warmth. The length is shorter, and the width is wider than a traditional adult-size towel. The fourth swaddling flap is used for the head and the head flaps are attached.

Embodiments provide advantages over conventional towels because, for example, a 2-piece hood with multiple functions provides move flexible head coverage, warmth, head accommodation, and helps to prevent cross-contamination infection. Conventional towels have, for example, a head shape that is triangular and sits across the child's forehead. Another conventional towel has a head shape that is more like a hood that covers the whole head so drying the face is difficult to achieve. Neither of the above-mentioned conventional towels provides thorough face and eye drying nor any features that help prevent cross-contamination infection.

In contrast, an embodiment has an attachment to a clover-like shape flap. The attachment (which may be permanent or temporary) has two, circular flaps that are flexible in use. The hood provides additional warmth to the child's head after bath time. This 2-piece hood allows for the hood to be adjusted to fit various size heads, from a newborn to a toddler. The 2-piece hood can be used to wipe dry the face and eyes of the child. Since it is a 2-piece hood, one flap of the hood can be used to wipe one eye and the other flap of the hood can be used to wipe the other eye. Use of the 2-piece hood helps to prevent cross-infection when cleaning the child's eyes after bath time. The 2-piece hood is flexible and can be positioned on the head for warmth and drying or the flaps can be pushed off to the sides of the child's face when not needed. A typical conventional head flap does not offer easy drying of the face and eyes, nor does it offer the clean-cloth wipe for each eye to protect from cross-contamination infection.

Embodiments provide advantages over conventional towels because of, for example, side hand flaps. As the child grows, independence is desired, but can be difficult to achieve when the child must work with a too-long or too-wide standard-size towel. An embodiment provides two side hand flaps which are multi-purpose. These side hand flaps allow the child to grasp the side handle flaps and wrap the towel around the body. The side hand flaps can also be used to hang the towel on a hook securely when not in use. The towel can have the same shape profile, both with and without handles.

Embodiments provide advantages over conventional towels because, for example, thickness. Conventional baby towels use thin fabric. The thin fabric does not provide much cushion to the child's body against the surface it is placed upon, nor does the thin fabric have the capacity to thoroughly absorb all the wetness from the child and becomes soaking wet. So, with a soaking wet towel and no cushion against a sturdy surface, the child becomes extremely uncomfortable, often resulting is crying, which in turn creates stress for the adult. Adult standard-size towels offer more thickness than a baby towel but are often difficult to maneuver so thorough drying can be awkward, and depending on the quality of the standard-size towel, the absorption may not be adequate. The invention offers at least twice the thickness of an adult standard-size towel, which provides superior absorption and cushioning comfort to the child and protects the adult from wetness.

Embodiments provide advantages over conventional towels because, for example, ease of use. One can either place the open towel on a flat surface or on the adult's shoulder, lift the child from the bath onto the towel, fold the bottom swaddling flap up to encase the legs, and fold the side swaddling flaps across the child's body, or if child is older, leave the bottom flap extended, then cover the head with the head flaps. If the child is a toddler or preschooler, one may place the towel on the child's head with the head flaps and fold the two side swaddling flaps across the body. There is no need to place a towel over the adult's head, fumble with a too-long towel, use clips or zip up the towel to keep it in place, or try and negotiate a wet, slippery baby into a pouch.

Thus, embodiments redesign conventional children's bath towels. An embodiment solves many problems that exist with current bath towels with its unique size, shape, head flaps, side hand flaps, and thickness. Embodiments create a less stressful bath-time experience for babies and the person giving the child a bath. The person giving the baby a bath will feel more in control and less nervous as the towel offers comfort and warmth, a cushion barrier from hard surfaces, provides effective absorption, and easy swaddling. All these benefits contribute to a more comfortable baby and quickly eliminate temperature shock and excessive crying. The head flaps offer warmth and safety protection that minimizes possible cross-contamination of infection to the baby's eyes. The overall size and shape of the towel can accommodate newborns, toddlers, and preschoolers. Toddlers and preschoolers can use the towel independently standing up, the head flaps can be placed on the child's head and the side hand flaps allow the child to draw in the side hand flaps to wrap the towel around the body. The bottom flap simply rests against the back of the child's legs. The thickness of the towel provides effective absorption and adult wetness protection and the side hand flaps make it easy for the child or adult to hang the towel when not in use.

An embodiment uses a terry cloth material that is soft and thick. Binding material for securing the outside edges of the towel may include cotton, polyester, or a similarly soft fabric.

Embodiments may be used to dry wet skin on an infant, toddler, preschooler. However, such embodiments may be instead or also used to swaddle a child.

Embodiments may include only a portion or subset of the features described herein and/or variations of such features. Various examples are now described. First, an embodiment may be smaller and adapted for infant-only use. Such an embodiment may forego side hand flaps and/or reduce the head flap size. Second, the shape may include rectangular flaps instead of round flaps. Third, side hand flaps may be changed to handles. For instance, a small width of fabric may attach to the top and bottom of the left and right swaddling flaps. The handles may also be used to hang the towel when not in use. Fourth, an embodiment may include a single thickness of terry cloth rather than double thickness; creating a lighter weight towel.

Thus, embodiments address many inadequacies noted by Applicant. For example, embodiments address many problems with conventional towels. Such conventional towels may be the wrong size; the wrong shape; too thin; unabsorbent; and provide no cushion to the child's body. Also, the adult standard-size towels are difficult to maneuver and use. The head shape of a conventional baby towel is inflexible and difficult to dry the face and eyes. In addition to solving these problems, an embodiment provides new benefits by adding wetness protection to the adult, prevention of cross-contamination infection, and provides extended use as the towel can grow with the child through the child's toddler and preschool years.

At times below a number from the Figures is included to facilitate understanding.

Numerical indicators are as follows: 1 (front of towel), 2 (back of towel), 3 (binding), 4 (head), 5 (left head flap), 6 (right head flap), 7 (left swaddling flap), 8 (right swaddling flap), 9 (bottom swaddling flap), 10 (left-hand side flap), 11 (right-hand side flap), 12 (thickness), 13 (hand towel). Other terms are used herein. For example, while 4 is sometimes referred to as "head" in other instances 4 is more generally referred to as a "lobe". As used herein, "left" and "right" may change depending on perspective. For example, lobe 7 may be the "left" or "right" lobe depending on whether viewed from the toddler's perspective or adult's perspective.

Various examples are now addressed.

Example 1. A towel comprising: a first lobe (7) and a second lobe (8), the first and second lobes opposing each other; a third lobe (4) and a fourth lobe (9), the third and fourth lobes opposing each other; a first appendage (10) coupled to the first lobe, a second appendage (11) coupled to the second lobe, a third appendage (5) coupled to the third lobe, and a fourth appendage (6) coupled to the third lobe; wherein the first, second, third, and fourth lobes are configured to be substantially included in a plane when the towel is unwrapped; wherein (a)(i) a first axis is orthogonal to the plane and the first axis intersects the first lobe and the first appendage, (a)(ii) a second axis is orthogonal to the plane and the second axis intersects the second lobe and the second appendage, (a)(iii) a third axis is orthogonal to the plane and the third axis intersects the third lobe, the third appendage, and the fourth appendage.

Embodiments are not limited to towels and may include, more generally, garments.

Embodiments are not limited to four lobes or to lobes in general.

Example 2. The towel of Example 1 wherein the first appendage includes a first flap, the second appendage includes a second flap, the third appendage includes a third flap, and the fourth appendage includes a fourth flap.

In other embodiments, for example, the first and second appendages may include strips of material that function as handles.

Example 2.1 The towel of claim 2 wherein the third and fourth flaps cooperate with one another to form a hood that projects away from the third lobe.

Example 2.2 The towel of claim 2, wherein: the first flap cooperates with the first lobe to form a first pouch; the second flap cooperates with the second lobe to form a second pouch; the third flap cooperates with the third lobe to form a third pouch; the fourth flap cooperates with the third lobe to form the third pouch.

Example 3. The towel of claim 2 wherein: the first lobe intersects the third lobe at a non-orthogonal angle; the second lobe intersects the third lobe at the non-orthogonal angle.

Another version of Example 3: The towel of claim 2 wherein: the first lobe intersects the third lobe at a first non-orthogonal angle; the second lobe intersects the third lobe at a second non-orthogonal angle; the first lobe intersects the fourth lobe at a third non-orthogonal angle; the second lobe intersects the fourth lobe at a fourth non-orthogonal angle.

In an embodiment, each of the first, second, third, and fourth non-orthogonal angles are the same but in other embodiments one or more of the first, second, third, and fourth non-orthogonal angles may differ from one another.

Example 4. The towel of claim 3 wherein: the first lobe intersects the fourth lobe at the non-orthogonal angle; the second lobe intersects the fourth lobe at the non-orthogonal angle.

However, in other embodiments the first lobe may intersect the fourth lobe at an orthogonal angle.

Example 5. The towel of claim 2 wherein the first, second, third, and fourth lobes are substantially arranged in a 4-leaf clover pattern with regard to each other.

For example, a 4-leaf clover has, generally, four lobes. As used herein, the "4-leaf clover" pattern excludes any stem on a clover and is restricted to the lobes or leaves or petals of the clover.

Example 6. The towel of claim 2 wherein the third and fourth appendages are slidingly coupled to each other.

Figure 4:
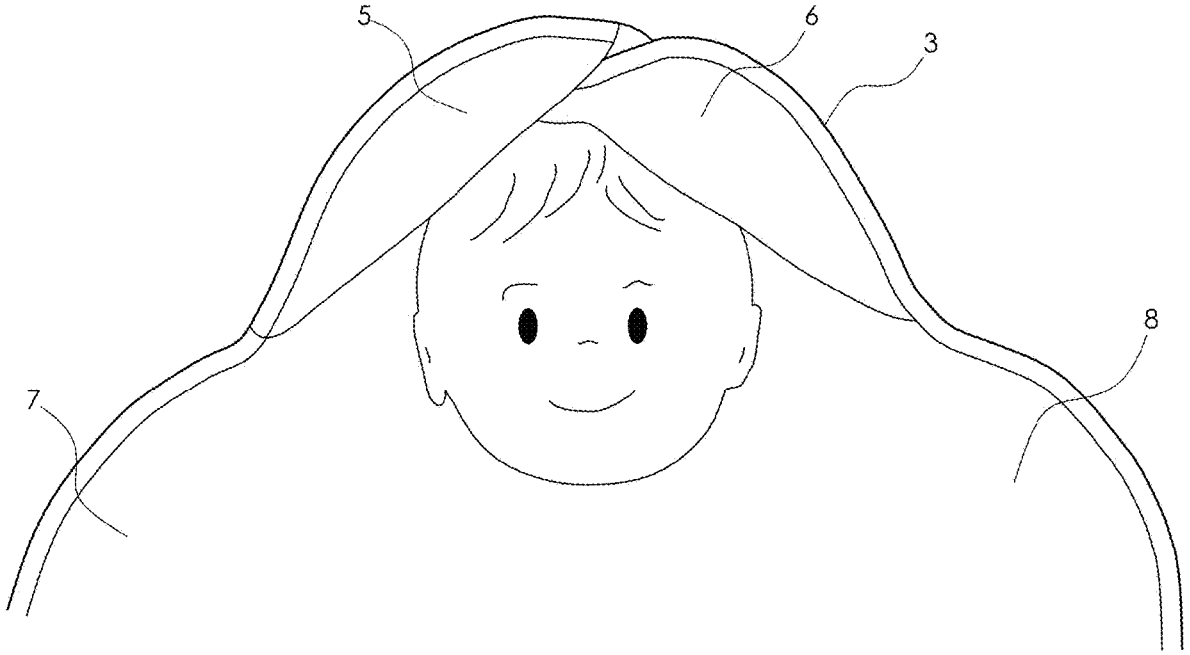
FIG. 4 depicts pushed aside head flaps of the embodiment.
Figure 5:
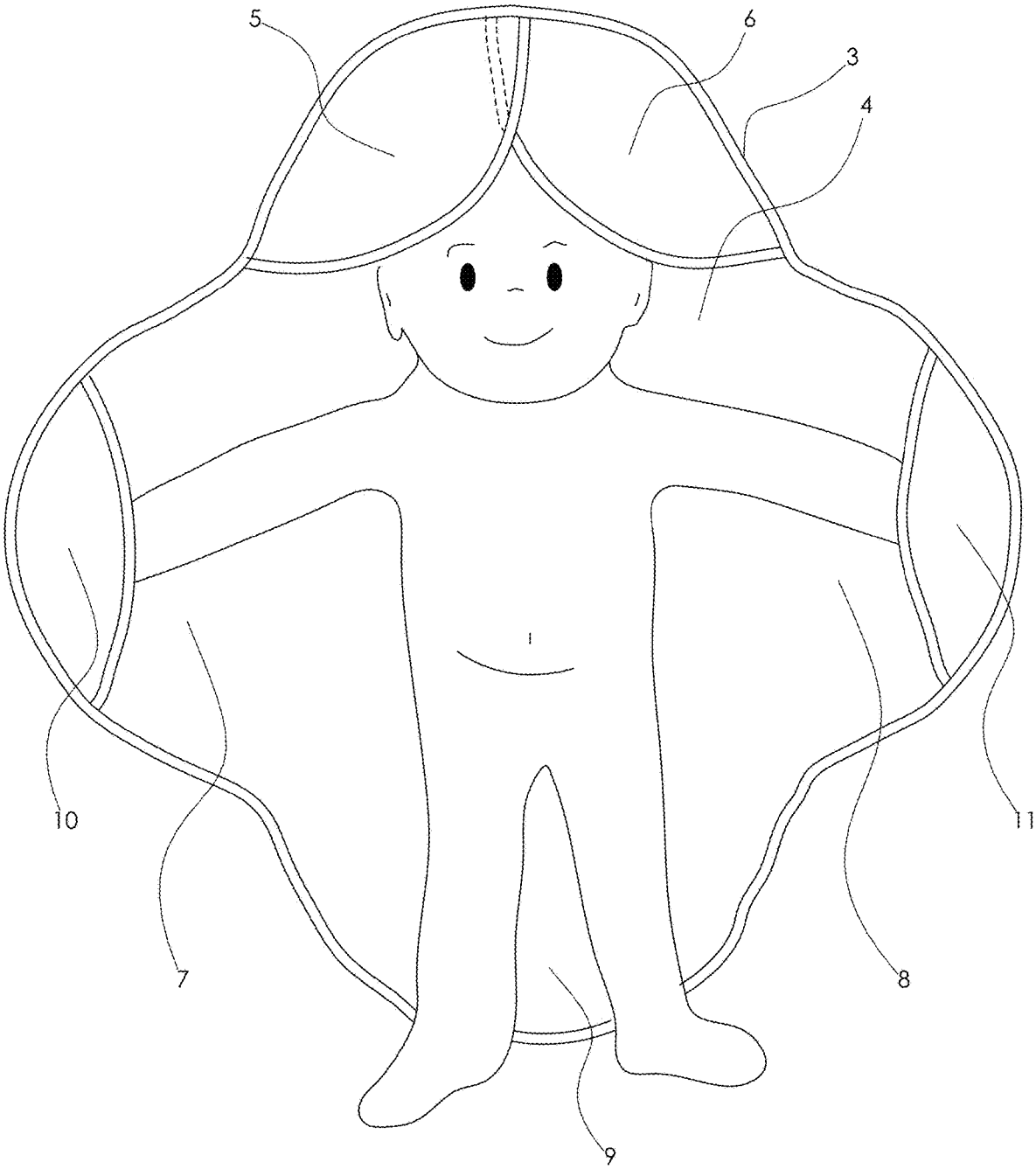
FIG. 5 depicts a toddler using hand flaps of the embodiment.
Figure 6:
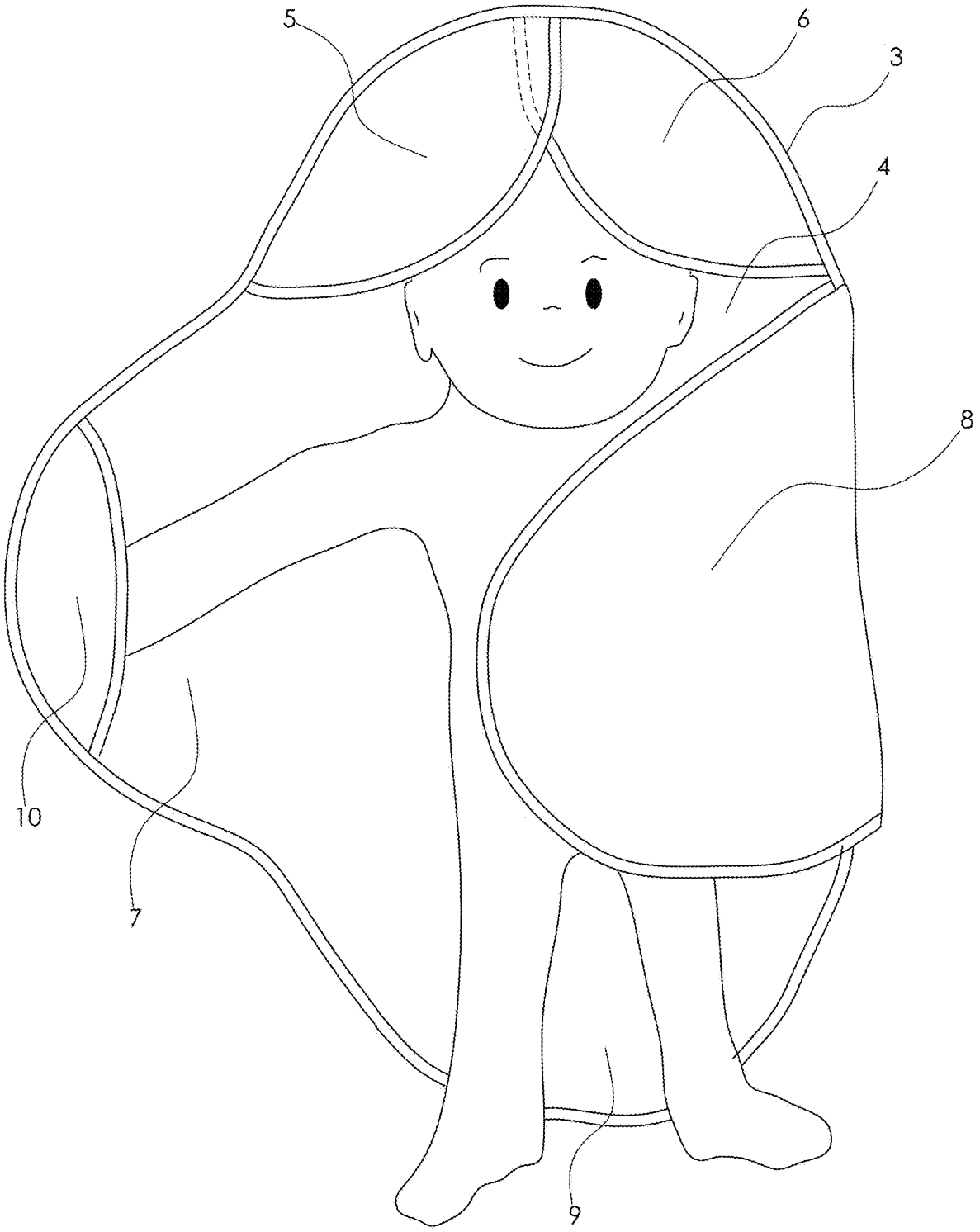
FIG. 6 depicts a toddler using hand flaps of the embodiment.
Figure 7:
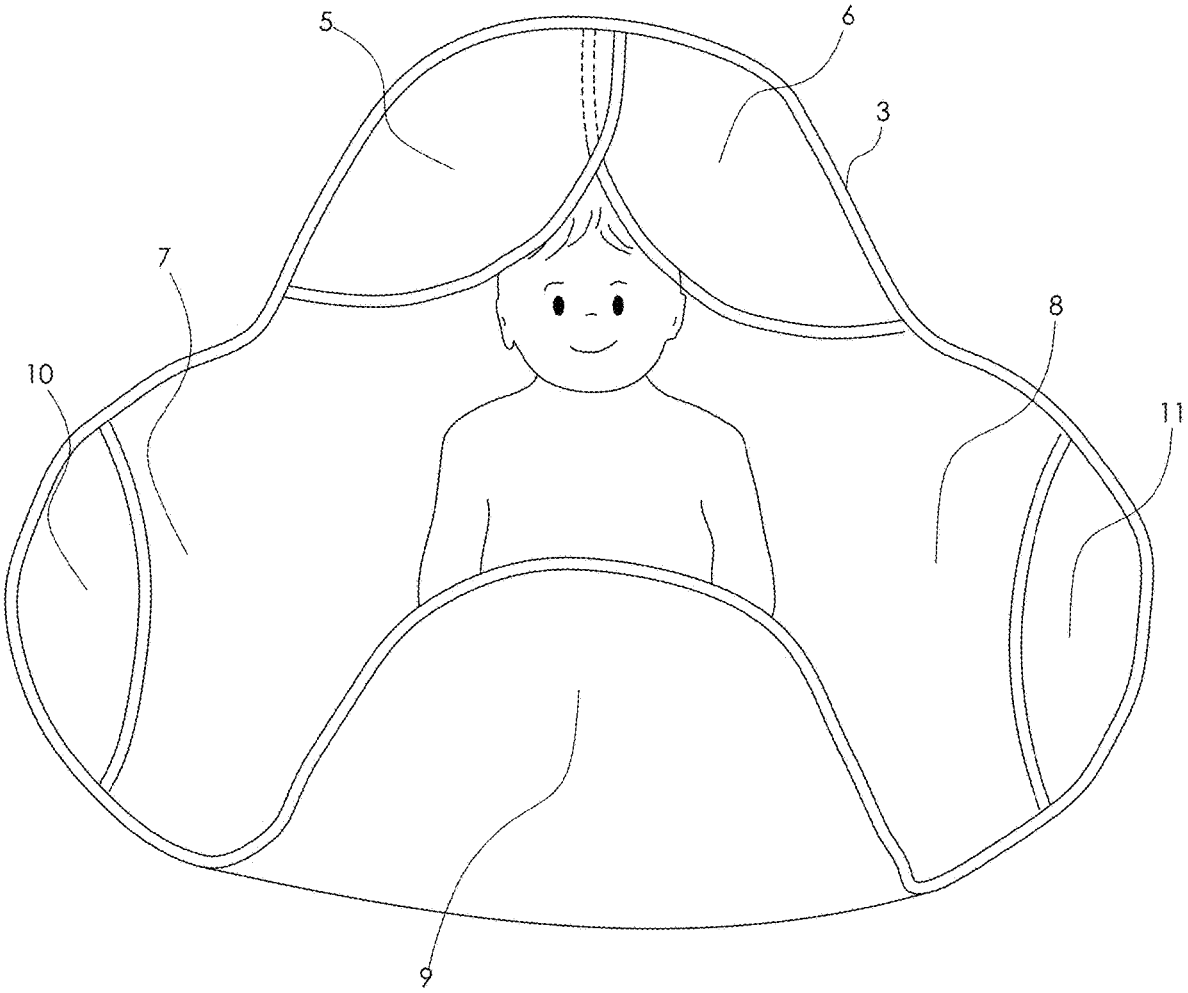
FIG. 7 depicts a bottom lobe being used as a swaddling flap in the embodiment.
Figure 8:
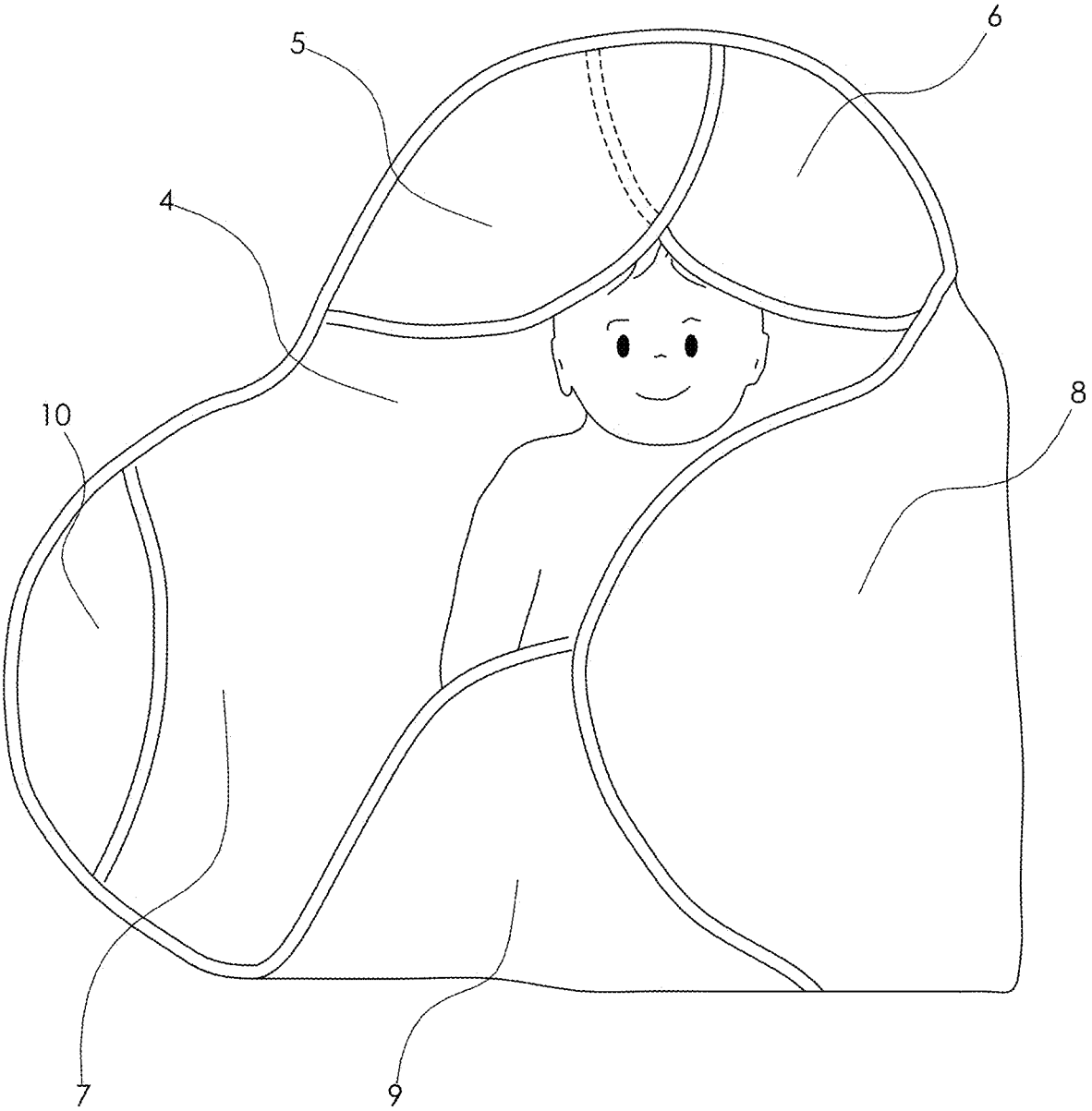
FIG. 8 depicts bottom and side lobes being used as swaddling flaps in the embodiment.
Figure 9:
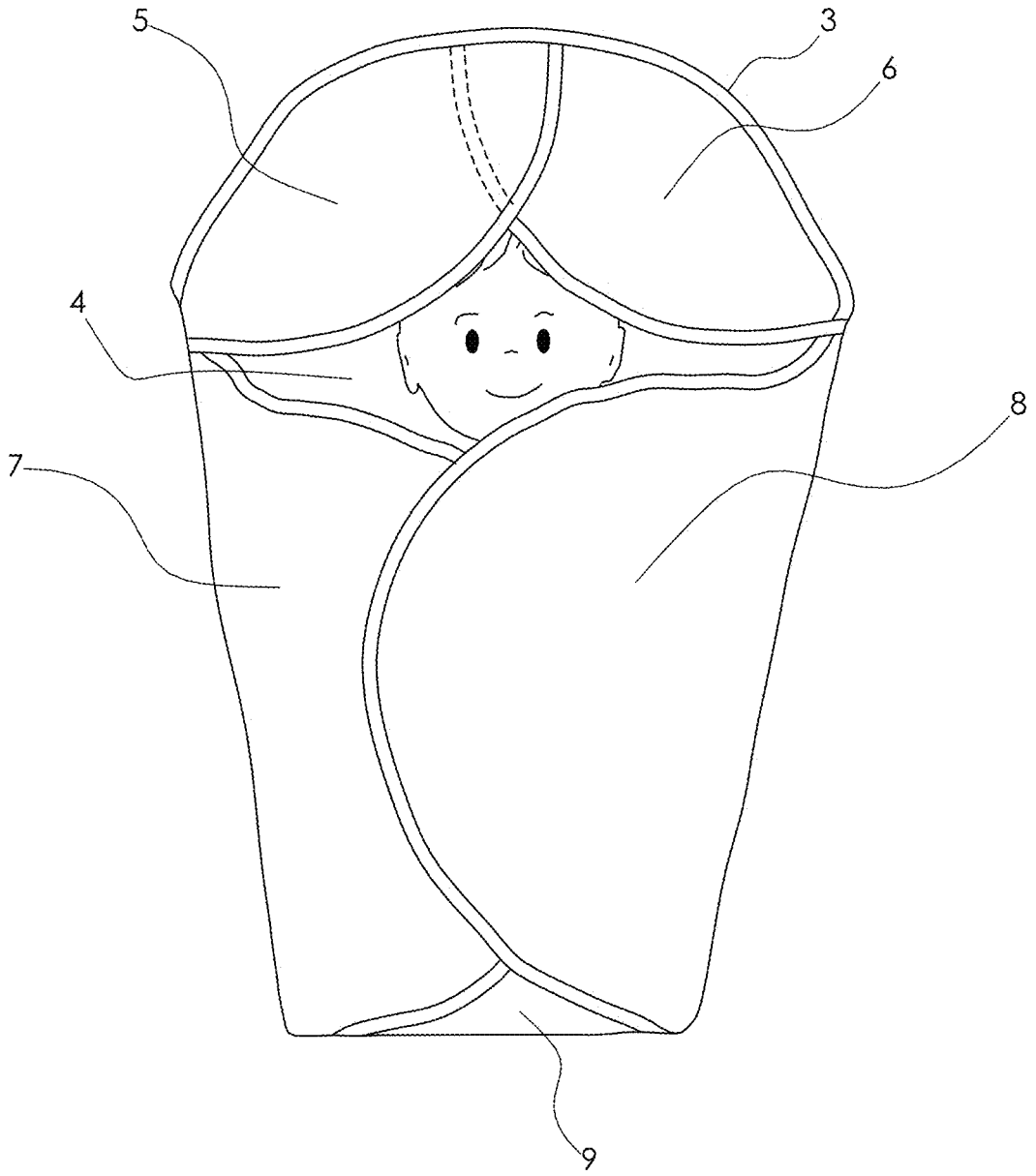
FIG. 9 depicts bottom and side lobes being used as swaddling flaps in the embodiment to fully swaddle a toddler/infant.
Figure 10:
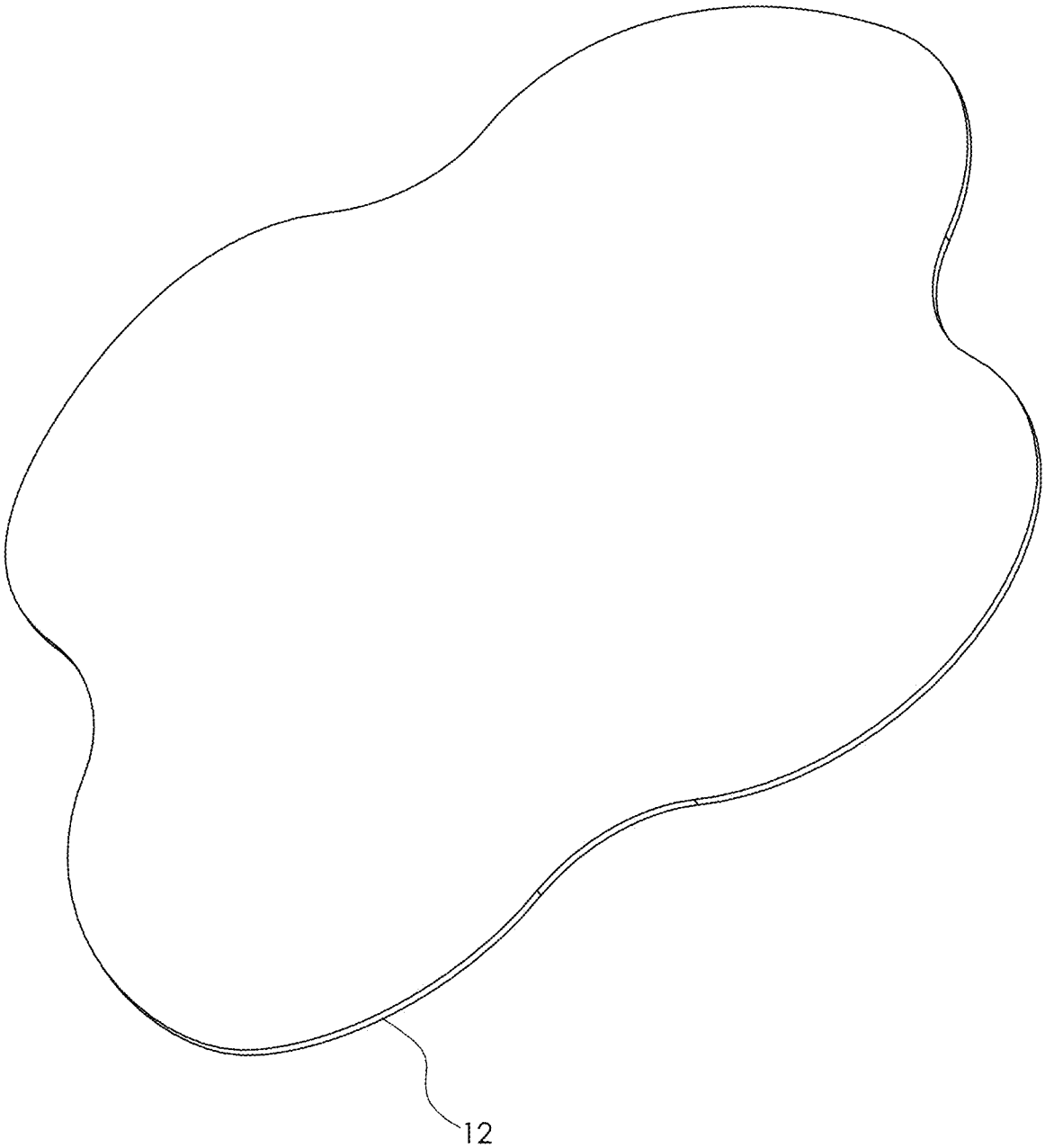
FIG. 10 depicts thickness of an embodiment.
Figure 11:
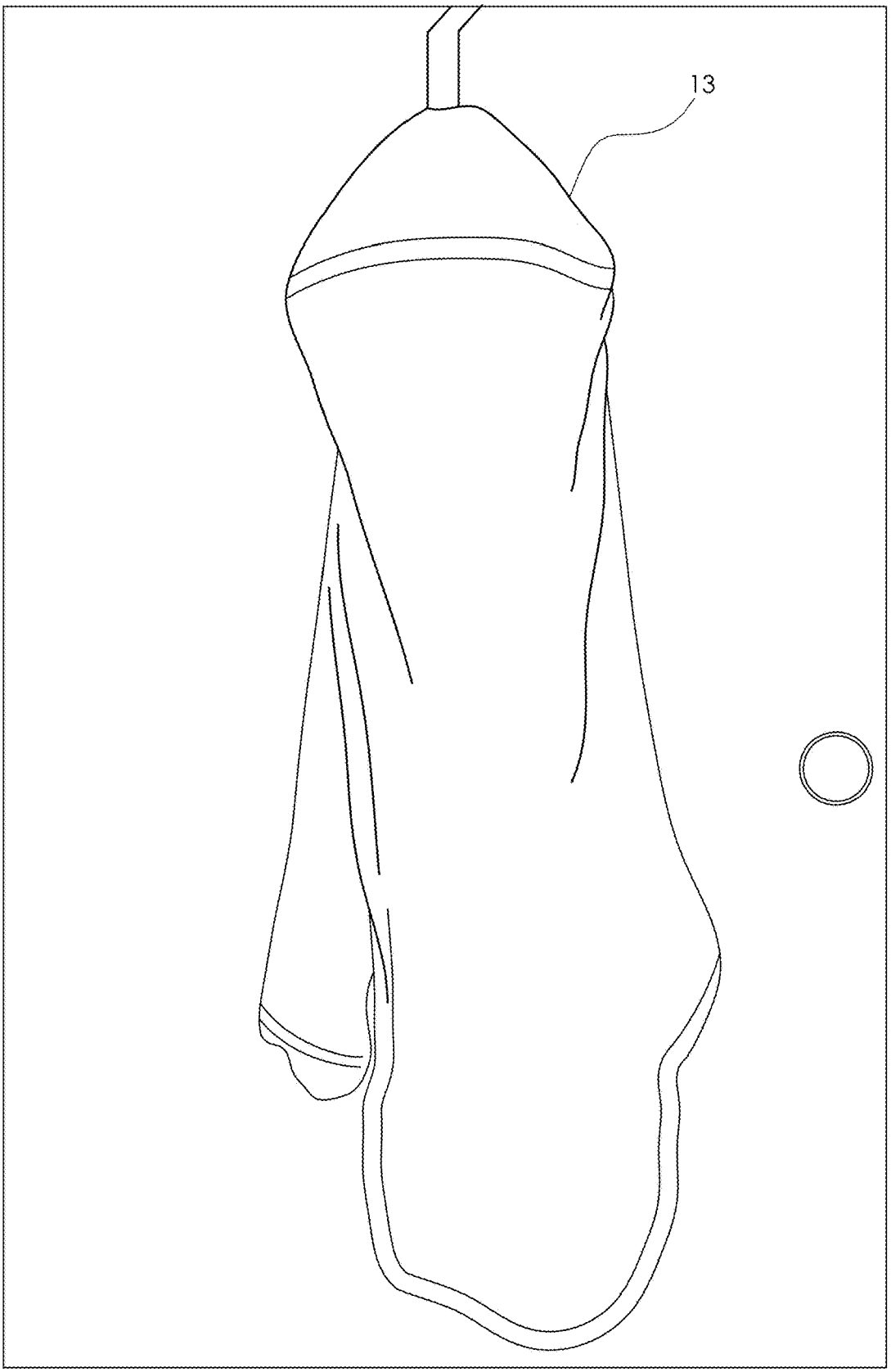
Figure 12:
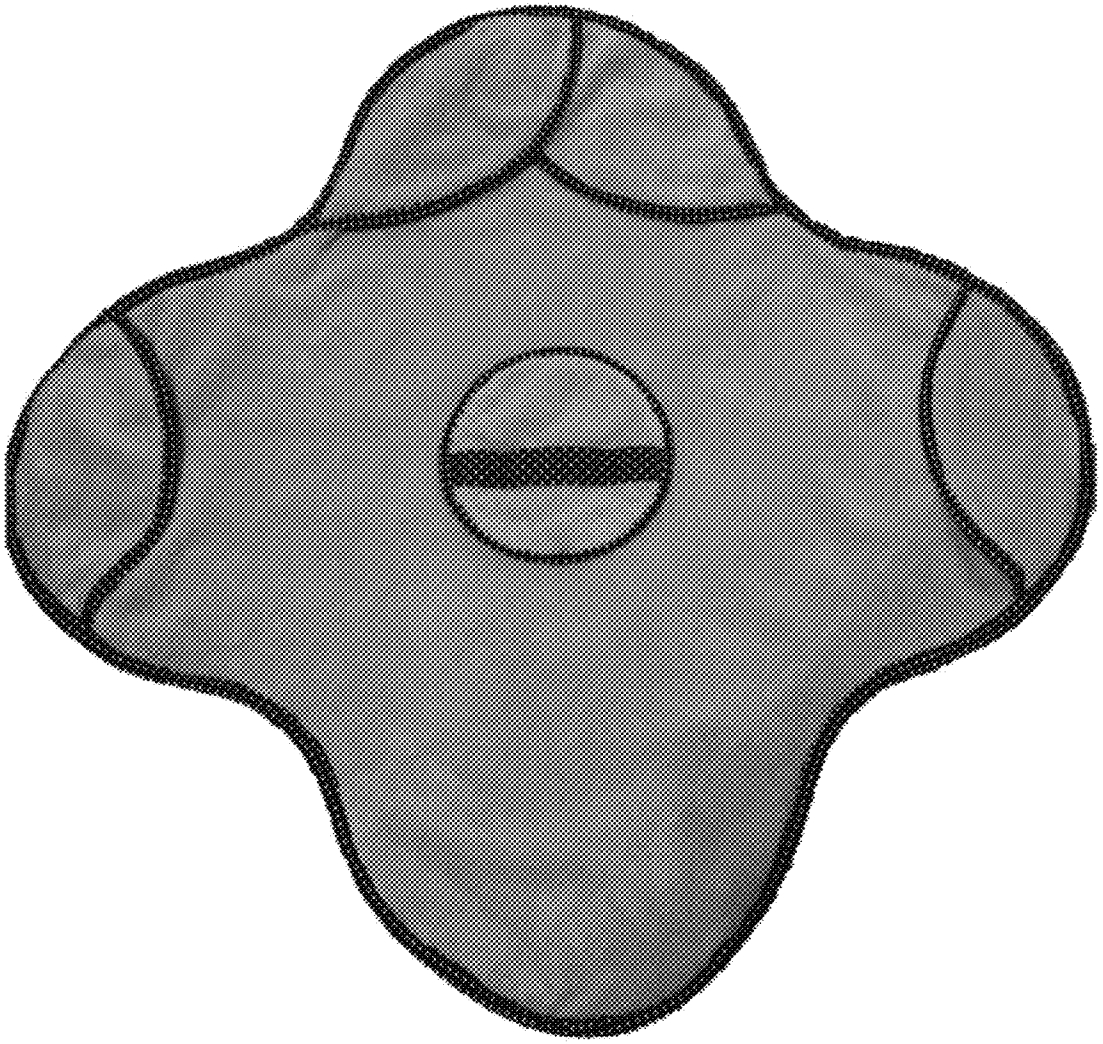
FIG. 12 depicts a front view of an embodiment.

For example, see FIG. 4.

Example 7. The towel of claim 6 wherein: an outermost edge of the first lobe is separated from an outermost edge of the second lobe by a first distance; an outermost edge of the third lobe is separated from an outermost edge of the fourth lobe by a second distance; the first distance equals the second distance.

Example 8. The towel of claim 6 wherein: an outermost edge of the first lobe is separated from an outermost edge of the second lobe by a first distance; an outermost edge of the third lobe is separated from an outermost edge of the fourth lobe by a second distance; the first distance is less than the second distance.

Example 9. The towel of claim 6 wherein: an outermost edge of the first lobe is separated from an outermost edge of the second lobe by a first distance; an outermost edge of the third lobe is separated from an outermost edge of the fourth lobe by a second distance; the first distance is greater than 30 inches; the second distance is less than 50 inches.

In a particular embodiment directed towards a child of a particular size, the dimensions are critical to address issues described above such as, for example, (1) too small or large of dimensions prevent full drying coverage, (2) too large of dimensions prevent "easy swaddling". Such a sized embodiment is larger than conventional baby towels and smaller than conventional adult towels. The dimensions are shorter in length and wider in width than a conventional adult towel. This "criticality" does not mean that all embodiments must have these dimensions.

In other embodiments the first distance is greater than 20, 25, 35, 40 or more inches. In other embodiments the second distance is less than 35, 40, 45, 55, or 60 inches.

In some embodiments the first distance is substantially equal (+/−5 inches) to the second distance.

Example 9.5 The towel of claim 9 wherein: the first lobe includes a portion having a weight (g/m2); the weight is between 550 g/m2 and 950 g/m2.

Example 9.6 The towel of claim 9 wherein: the first lobe includes a portion having a first weight (g/m2); the third flap includes a portion having a second weight (g/m2); the second weight is less than the first weight.

Figure 2:
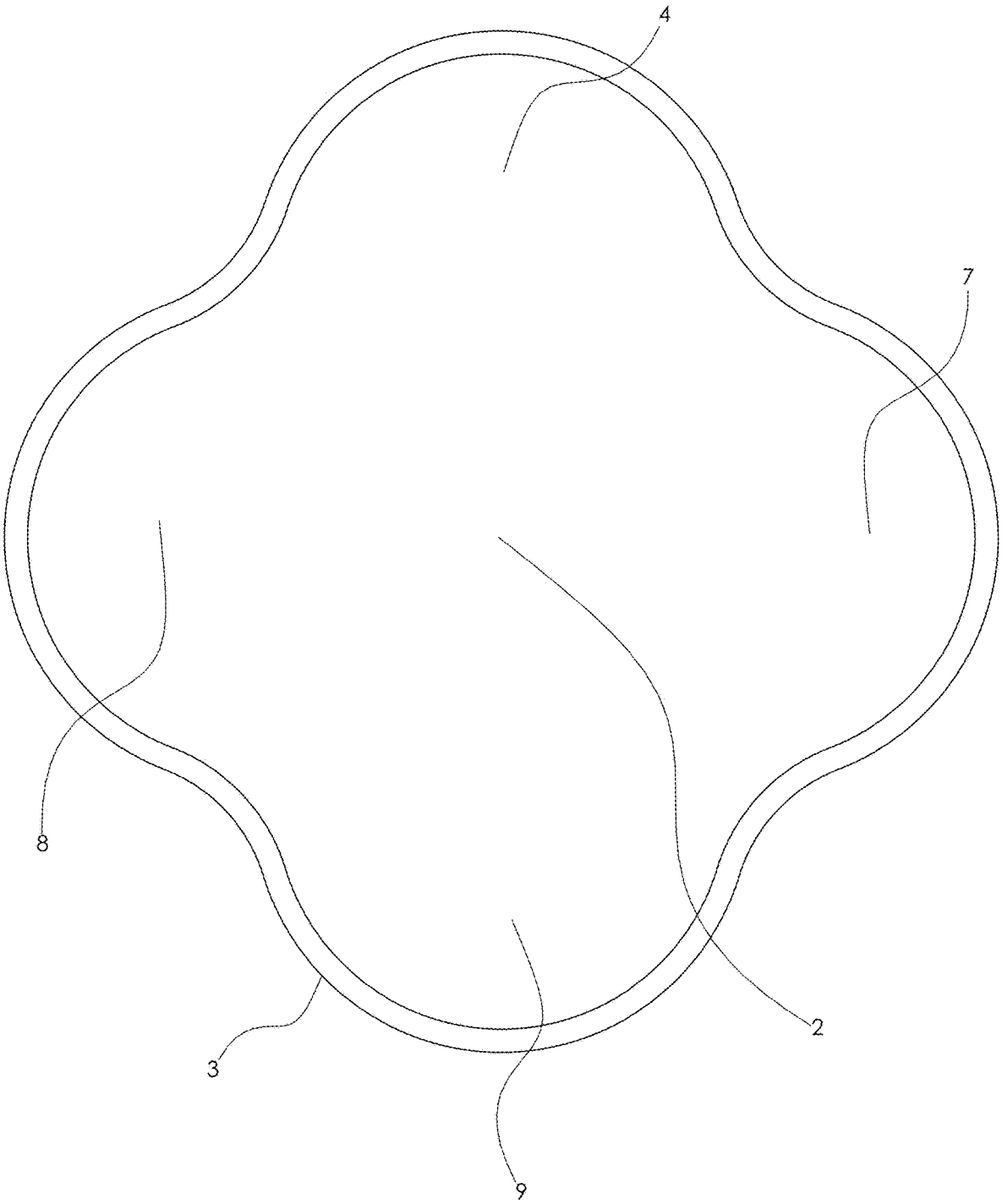
FIG. 2 depicts a rear view of the embodiment.
Figure 3:
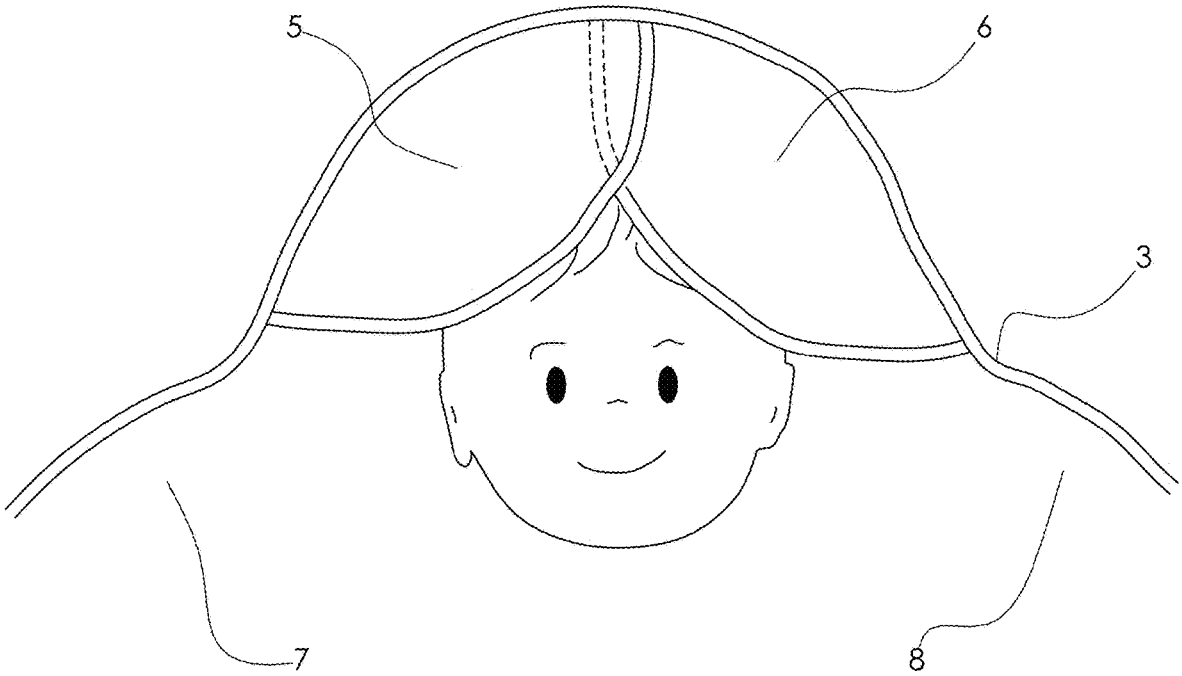
FIG. 3 depicts a head flaps of the embodiment.

Some embodiments may include varying weight. For example, a back portion (element 2 of FIG. 2) may be of higher weight than portions 5, 6, 10, or 11. As a result, the back portion may be better able to cushion the user and absorb fluids while the appendages for the hood may be thinner and more flexible to more easily wipe the user's eyes.

As used herein, fabric weight is measured in GSM (g/m2). This number refers to the density of the garment.

In many situations herein, the thickness of a garment is addressed. Such references to "thickness" are analogous to "weight" as addressed immediately above. Thus, conventional garments that are too thin are analogous to garments not having enough weight. Advantages of embodiments that are "thicker" are analogous to advantages due to the increased weight of the embodiment.

In other embodiments the weight may be 500, 600, 700, 800, 900, 1000 g/m2 or more.

In an embodiment the garment may be made of multiple layers. For example, two layers may be sewn together such that a cross-section (taken across the garment from elements 8 to 7 of FIG. 1 at element 2 of FIG. 2 would show essentially two towels with one towel on top of another towel. The two layers may be sewn together along the perimeter of the garment.

Example 10. The towel of claim 2 wherein: the first appendage is fixedly and permanently coupled to the first lobe; the second appendage is fixedly and permanently coupled to the second lobe; the third appendage is fixedly and permanently coupled to the third lobe; the fourth appendage is fixedly and permanently coupled to the third lobe.

For example, the first appendage may be stitched or sewn to the first lobe.

Example 11. The towel of claim 2 wherein: the first appendage is removably coupled to the first lobe; the second appendage is removably coupled to the second lobe; the third appendage is removably coupled to the third lobe; the fourth appendage is removably coupled to the third lobe.

For instance, the appendages may couple to the lobes via a hook and fastener system (e.g., Velcro®). This may allow a user to remove the appendages as the child grows or according to user preference.

Example 11.5 The towel of claim 2, wherein the fourth lobe is larger than at least one of the first, second, or third lobes.

For example, having a large lobe for the user's legs/feet may help facilitate swaddling and the like.

Example 11.6 The towel of claim 2, wherein the fourth lobe is substantially equal in size to each of the first, second, and third lobes.

Having the lobes each be substantially equal in size (+/−5 in^2) may facilitate folding/swaddling.

Example 12. A towel comprising: a first lobe and a second lobe, the first and second lobes opposing each other; a third lobe and a fourth lobe, the third and fourth lobes opposing each other; a first appendage coupled to the first lobe and a second appendage coupled to the first lobe; wherein the first, second, third, and fourth lobes are configured to be substantially included in a plane when the towel is unwrapped; wherein an axis is orthogonal to the plane and the axis intersects the first lobe, the first appendage, and the second appendage.

For example, some embodiments may include a hood with two appendages but the lobes corresponding to a user's hands may not include appendages.

Example 13. The towel of claim 12 wherein the first appendage includes a first flap and the second appendage includes a second flap.

Example 14. The towel of claim 13 wherein: the first lobe intersects the third lobe at a non-orthogonal angle; the second lobe intersects the third lobe at the non-orthogonal angle.

Example 15. The towel of claim 14 wherein: the first lobe intersects the fourth lobe at the non-orthogonal angle; the second lobe intersects the fourth lobe at the non-orthogonal angle.

Example 16. The towel of claim 15 wherein the first, second, third, and fourth lobes are substantially arranged in a 4-leaf clover pattern with regard to each other.

Example 17. The towel of claim 16 wherein the first and second appendages are slidingly coupled to each other.

Example 18. The towel of claim 17 wherein: an outermost edge of the first lobe is separated from an outermost edge of the second lobe by a first distance; an outermost edge of the third lobe is separated from an outermost edge of the fourth lobe by a second distance; the first distance equals the second distance.

Example 19. The towel of claim 6 wherein: an outermost edge of the first lobe is separated from an outermost edge of the second lobe by a first distance; an outermost edge of the third lobe is separated from an outermost edge of the fourth lobe by a second distance; the first distance is less than the second distance.

Example 20. The towel of claim 6 wherein: an outermost edge of the first lobe is separated from an outermost edge of the second lobe by a first distance; an outermost edge of the third lobe is separated from an outermost edge of the fourth lobe by a second distance; the second distance is greater than 30 inches; the first distance is less than 50 inches.

In a particular embodiment directed towards a child of a particular size, the dimensions are critical to address issues described above such as, for example, (1) too small or large of dimensions prevent full drying coverage, (2) too large of dimensions prevent "easy swaddling". Such a sized embodiment is larger than conventional baby towels and smaller than conventional adult towels. The dimensions are shorter in length and wider in width than a conventional adult towel. This "criticality" does not mean that all embodiments must have these dimensions.

Example 20.5 The towel of claim 20 wherein: the first lobe includes a portion having a weight (g/m2); the weight is between 550 g/m2 and 950 g/m2.

Example 21. The towel of claim 13 wherein: the first appendage is fixedly and permanently coupled to the first lobe; the second appendage is fixedly and permanently coupled to the first lobe.

Example 22. The towel of claim 13 wherein: the first appendage is removably coupled to the first lobe; the second appendage is removably coupled to the first lobe.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A towel comprising:

a first lobe and a second lobe, the first and second lobes opposing each other;

a third lobe and a fourth lobe, the third and fourth lobes opposing each other;

a first appendage coupled to the first lobe, a second appendage coupled to the second lobe, a third appendage coupled to the third lobe, and a fourth appendage coupled to the third lobe;

wherein the first, second, third, and fourth lobes are configured to be substantially included in a plane when the towel is unwrapped;

wherein (a)(i) a first axis is orthogonal to the plane and the first axis intersects the first lobe and the first appendage, (a)(ii) a second axis is orthogonal to the plane and the second axis intersects the second lobe and the second appendage, (a)(iii) a third axis is orthogonal to the plane and the third axis intersects the third lobe, the third appendage, and the fourth appendage;

wherein (b)(i) an outermost edge of the first lobe is separated from an outermost edge of the second lobe by a first distance; (b)(ii) an outermost edge of the third lobe is separated from an outermost edge of the fourth lobe by a second distance; and (b)(iii) the first distance is equal to or less than the second distance.

2. The towel of claim 1 wherein the first appendage includes a first flap, the second appendage includes a second flap, the third appendage includes a third flap, and the fourth appendage includes a fourth flap.

3. The towel of claim 2 wherein the third and fourth flaps cooperate with one another to form a hood that projects away from the third lobe.

4. The towel of claim 2, wherein:

the first flap cooperates with the first lobe to form a first pouch;

the second flap cooperates with the second lobe to form a second pouch;

the third flap cooperates with the third lobe to form a third pouch;

the fourth flap cooperates with the third lobe to form the third pouch.

5. The towel of claim 2 wherein:

the first lobe intersects the third lobe at a first non-orthogonal angle;

the second lobe intersects the third lobe at a second non-orthogonal angle;

the first lobe intersects the fourth lobe at a third non-orthogonal angle;

the second lobe intersects the fourth lobe at a fourth non-orthogonal angle.

6. The towel of claim 5 wherein the first, second, third, and fourth lobes are substantially arranged in a 4-leaf clover pattern with regard to each other.

7. The towel of claim 2 wherein the third and fourth appendages are slidingly coupled to each other.

8. The towel of claim 7 wherein the first distance equals the second distance.

9. The towel of claim 7 whereini the first distance is less than the second distance.

10. The towel of claim 7 wherein the first distance is greater than 30 inches; and the second distance is less than 50 inches.

11. The towel of claim 10 wherein:

the first lobe includes a portion having a first weight ($g/m^2$);

the third flap includes a portion having a second weight ($g/m^2$);

the second weight is less than the first weight.

12. The towel of claim 7 wherein:

the first appendage is removably coupled to the first lobe;

the second appendage is removably coupled to the second lobe;

the third appendage is removably coupled to the third lobe;

the fourth appendage is removably coupled to the third lobe.

13. The towel of claim 7, wherein the third appendage is between the third lobe and the fourth appendage.

14. A towel comprising:

a first lobe and a second lobe, the first and second lobes opposing each other;

a third lobe and a fourth lobe, the third and fourth lobes opposing each other;

a first appendage coupled to the first lobe and a second appendage coupled to the first lobe;

wherein the first, second, third, and fourth lobes are configured to be substantially included in a plane when the towel is unwrapped;

wherein the first and second appendages are not included in the plane;

wherein an axis is orthogonal to the plane and the axis intersects the first lobe, the first appendage, and the second appendage;

wherein (a) an outermost edge of the first lobe is separated from an outermost edge of the second lobe by a first distance; (b) an outermost edge of the third lobe is separated from an outermost edge of the fourth lobe by a second distance; and (c) the first distance is equal to or less than the second distance.

15. The towel of claim 14 wherein the first appendage includes a first flap and the second appendage includes a second flap.

16. The towel of claim 15, wherein the first appendage is between the first lobe and the second appendage.

17. The towel of claim 16 wherein the first and second appendages are slidingly coupled to each other.

18. The towel of claim 17 whereim the first distance is less than the second distance.

19. The towel of claim 17 wherein the second distance is greater than 30 inches;

the first distance is less than 50 inches.

20. The towel of claim 14 wherein:

the first appendage is removably coupled to the first lobe;

the second appendage is removably coupled to the first lobe.

* * * * *